United States Patent [19]

Kramer

[11] Patent Number: 5,030,013

[45] Date of Patent: Jul. 9, 1991

[54] WATERPROOF CONTAINER AND METHOD OF USING THE SAME

[76] Inventor: Robert M. Kramer, 104 W. 70th St., Apt. 9F, New York, N.Y. 10023

[21] Appl. No.: 455,269

[22] Filed: Dec. 22, 1989

[51] Int. Cl.[5] ..... B65D 33/16

[52] U.S. Cl. ..... 383/61; 383/36; 383/49; 383/90; 383/91; 383/904

[58] Field of Search ..... 383/90, 91, 904, 43, 383/48, 49, 36, 35, 80, 61

[56] References Cited

U.S. PATENT DOCUMENTS

| | | | |
|---|---|---|---|
| 1,183,962 | 5/1916 | Eggers | 383/43 |
| 2,040,271 | 5/1936 | Rosenzweig | 383/43 |
| 2,273,128 | 2/1942 | Madsen et al. | 383/904 |
| 2,798,522 | 7/1957 | Hurt | 383/90 |
| 2,918,282 | 12/1959 | Waterval | 383/90 |
| 3,724,461 | 4/1973 | Eisenberg | 383/35 |
| 3,734,154 | 5/1973 | Polk | 383/35 |
| 3,982,574 | 9/1976 | Bianchi et al. | 383/90 |
| 4,262,801 | 4/1981 | Avery | 383/82 |
| 4,421,150 | 12/1983 | Masters | 383/86 |
| 4,570,820 | 2/1986 | Murphy | 383/26 |

FOREIGN PATENT DOCUMENTS

| | | | |
|---|---|---|---|
| 358191 | 12/1961 | Switzerland | 383/90 |

*Primary Examiner*—Stephen P. Garbe

*Attorney, Agent, or Firm*—Ladas & Parry

[57] ABSTRACT

A bag is provided which is inclusive of a mouth for the insertion of objects to be stored in the bag. The bag is provided with an input section at the mouth to guide the objects via the mouth into the bag. The input section is adapted for being curled in order to function as a closure for the mouth. A retainer is furthermore provided for being hooded over the input section with the latter having been curled thereby to retain the closure at the mouth. A substantially rigid bar of curved form is provided on the bag at the mouth for imparting a curved conformation to the structure to enhance the closure. The retainer is preferably of a pouch-like configuration defining a receptacle to receive the input section in its curled condition. The bag and input section are of a monolithic construction which is of a waterproof material.

10 Claims, 1 Drawing Sheet

WATERPROOF CONTAINER AND METHOD OF USING THE SAME

FIELD OF INVENTION

This invention relates to containers and methods of making and using the same and more particularly to waterproof containers especially suitable for the temporary storage of objects in such a manner that the owner of the objects can carry the same in a convenient manner while engaged in water-related activities and the like.

BACKGROUND

Individuals who participate in water-related activities such as swimming or boating frequently have no convenient and safe place to keep the valuables (e.g., wristwatch, wallet, jewelry, money, etc.). Therefore most people are forced to carry with them a minimum of money and valuables in the expectation that they will be unable to protect the same while engaged in water-related activities.

At a beach, for example, valuables can be put into a storage unit such as for example a shoe or rolled up in a towel or in clothes when the owner goes into the water. However, no matter where the articles are hidden, once the owner leaves the area to enter the water, the articles are not protected and are therefore readily accessible for unauthorized removal.

A search for material having some relationship to the aforegoing problem has uncovered U.S. Pat. Nos. 3,203,551; 3,998,304; 4,155,453; 4,262,801; 4,421,150.

In U.S. Pat. No. 3,203,551, N. Van Loan reveals a bag of textile fabric material having integral closure means made from a portion of the bag and an integral flexible non-metallic fastener. The bag structure consists of front and rear walls connected at their bottom and side edges and opened at the top to provide a mouth. A cover flap is provided adjacent the mouth and securing arrangements attached to the flap are provided including a pair of tab members and a plurality of non-metallic securing elements. A further securing arrangement is provided which is secured to the outer surface of the front and rear walls below and spaced from the first securing arrangement. The securing arrangements appear to be made of Velcro.

C. Edgerton reveals in U.S. Pat. No. 3,998,304 a storage container adapted to be collapsed and folded upon itself for compact storage. The container consists of a flexible waterproof material having an elongated opening which is rendered substantially waterproof by a tubular portal element which is opened at its ends. One end of the element surrounds the container opening and is sealed to the wall of the container so that access to the container is obtained only through the tubular portal element. The opening is sealed by flattening the tubular element and rolling it upon itself substantially parallel to the longitudinal dimension of the opening. Fastening strips extend along opposite sides of the longitudinal opening to provide a mechanical closure.

In U.S. Pat. No. 4,155,453 D. Ono provides an inflatable grip container. This container is provided with a double wall provided with an intake for inflation thereof and with a quick release for rapid deflation. A compartment is formed having a sleeve which can be folded in order to completely seal the compartment between the double walls. A fastener such as a zipper is provided to fasten the sleeve in sealing position. The inner walls of the double wall construction are stretchable so that when inflated they conform to the contour of the article stored therein.

J. Avery provides in U.S. Pat. No. 4,262,801 a container including inner and outer container bodies which are marginally connected. The bottom of the compartment within the inner container is arranged at a substantial distance above the bottom of the outer container. The inner container serves as a partition between first and second inflation chambers having air flow ports. The upper end of the outer container can be wrapped into a spiral formation to seal the compartment and the container as a whole.

In U.S. Pat. No. 4,421,150 W. Masters provides a waterproof bag for the storage of articles. This bag has a waterproof enclosure contained within an outer case having a cover flap which fastens over a closure by means of a yieldable fastener made of Velcro to seal therein an article in an air-tight waterproof environment. Air entrapped therein provides buoyancy and a safety fastener maintains the closure seal should the cover flap become unfastened under pressure.

SUMMARY OF INVENTION

It is an object of the present invention to provide an improved container for the storage of personal valuables in a water-tight environment.

It is another object of the invention to provide an improved container or bag which is capable of being secured to its owner without hampering the owners' ability to enjoy and participate in water-related activities.

It is yet a further object of the invention to provide an improved container which is readily manufactured with mass production techniques and which provides an economic storage for articles which are to be carried into the water or subjected to accidental immersion therein.

Yet another object of the invention is to provide an improved water-tight bag adapted for being conveniently portable and attachable to the person of its owner and which is easy to open and close with repeatable perfect sealing and which will remain unaffected by exposure to the elements such as will be found at the beach or the like.

Still another object of the invention is to provide improved means to permit beachgoers and swimmers and the like to keep their valuables in close proximity and in conditions of water-tight security.

Still another object of the invention is to provide improved methods for the fabrication and utilization of water-tight bags and the like.

In achieving the above and other objects of the invention, there is provided an article of manufacture inclusive of a bag having a mouth for the insertion of objects, an input section on the bag at said mouth to guide these objects via the mouth into the bag and adapted for being curled in order to function as a closure for the mouth, and a retainer adapted for being hooded over the input section with the latter in curled posture thereby to retain the closure at the mouth.

In a preferred embodiment of the invention as will be described in detail hereinbelow, the bag and input section are of continuous monolithic structure and there is provided a substantially rigid device of curved form on the structure at the mouth for imparting a curved conformation to the structure to enhance the closure.

According to a feature of the invention, the retainer is of a pouch-like configuration defining a receptacle to receive the input section in curled posture. This retaining device may be of knitted fabric or of rubber or the like. It is preferably elastic to aid in performing its function of maintaining the closure. As will be seen, the monolithic structure is preferably of a water-proof material and may, for example, be of a polymeric material which for example is folded to have two sections in face-to-face relationship, the sections being laterally connected in water-tight relationship.

As will also be seen below, the rigid device is preferably in the form of a curved bar connected to one of the two sections at the mouth and the bar is moreover in a preferred version positioned internally of the monolithic structure to traverse the same at the mouth. The retainer is preferably connected externally of the monolithic structure in correspondence with the aforementioned bar to be imparted a curved form thereby. As will also be seen hereinbelow and with reference to annexed drawings the two sections of the monolithic structure are laterally connected to form flat margins provided with at least one opening and preferably more, which openings are adapted to accommodate a leash or strap.

It will also be noted in the description which follows hereinafter that the retainer is of a greater width than the input section and is hooded over the lateral extremities of the input section with the input section in curled posture. It will also be noted from the description which follows hereinafter that the curved bar has a radius which is greater than the width of the bag.

As also mentioned above, the invention relates as well as to a method. This method may be regarded as including the steps of forming a bag with a mouth and with an input section on the bag at the mouth and in extension of the bag, attaching a retainer to the bag at the mouth, curling the input section on itself at the mouth to affect a closure of the mouth, and hooding the retainer over the thusly curled input section to maintain the closure.

Other aspects of the method may be regarded as including curving the bag and input section at the mouth to facilitate maintaining the closure, curving the bag and input section at the mouth by attaching a curved rigid member to the bag at the mouth, and curling the input section in the form of two nesting U-shaped sections.

Other objects, features and advantages of the invention will be found in the detailed description which follows hereinbelow and which is illustrated in the accompanying drawing.

DETAILED DESCRIPTION

As noted above, the invention is concerned with the provision of a device and with related methods whereby there is provided a bag or container to keep personal articles dry in a water-tight environment and in a structure that preferably is attachable to selected parts of the body of the owner by means of appropriate straps or leashes. The bag is intended to permit beach-goers and swimmers and the like to keep their valuables on their person in conditions of water-tight security. The structure of the invention is intended to be conveniently portable and easy to open and close with repeatable perfect sealing during each operation, the structure being preferably unaffected by conditions which generally exist at the beach such as exposure to the sun, salt water, sand and the like.

As will be seen, the container of the invention permits the keeping of personal articles or valuables in conditions of water-tight security while being attached to the owner without hampering the owners' ability to enjoy and participate in water-related activities. For that purpose the bag is designed to entrap as little air as possible thereby to result in the smallest and slimmest profile for the wearer. As will also be noted, it is possible within the scope of the invention to provide straps or leashes designed for attachment to the wrist, waist, ankle, thigh or forearm of the wearer and these straps may be permanently attachable to the container or removable and replaceable.

Although the container shown in the attached drawing is shown as having a generally rectangular shape any other configuration that can be carried comfortably and conveniently adjacent the human body is equally acceptable. It will be noted that the container of the invention can be fabricated of a single ply waterproof and flexible material such as rubber or plastic of adequate thickness for strength and durability and that the container is formed with an extended opening to allow the input section to be folded back upon itself and to be curved by an associated rigid bar that is securely positioned across the bag at the mouth thereof. It will also be noted that a piece of elastic material that is used to form a pouch restrains the folded input section from unravelling or uncurling, the pouch is preferably designed to hold the folded input section tightly. To help users of containers of the invention to fold the extended input section properly, sequential numbers may be placed at appropriate positions at fold points as a guide.

Figure 1:
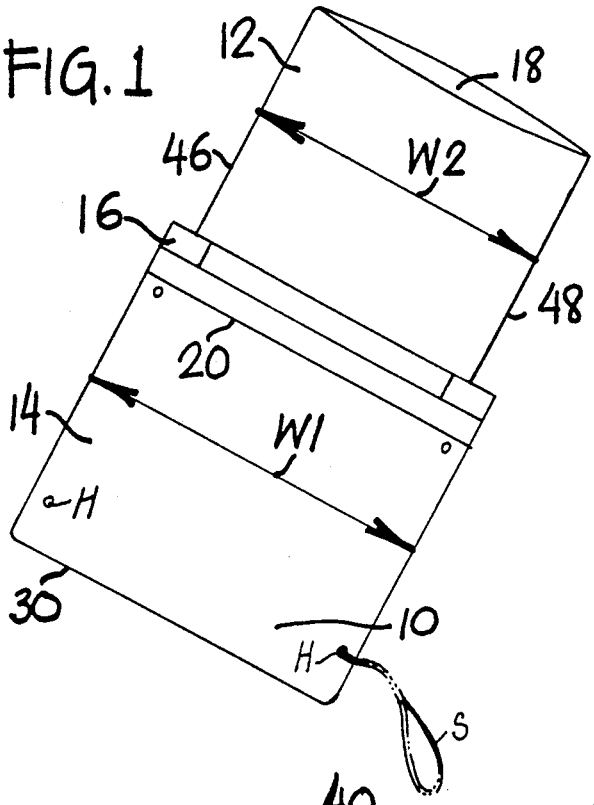
FIG. 1 is a diagrammatic view of a bag provided in accordance with the invention with an input section provided on the bag in extension of the same.
Figure 2:
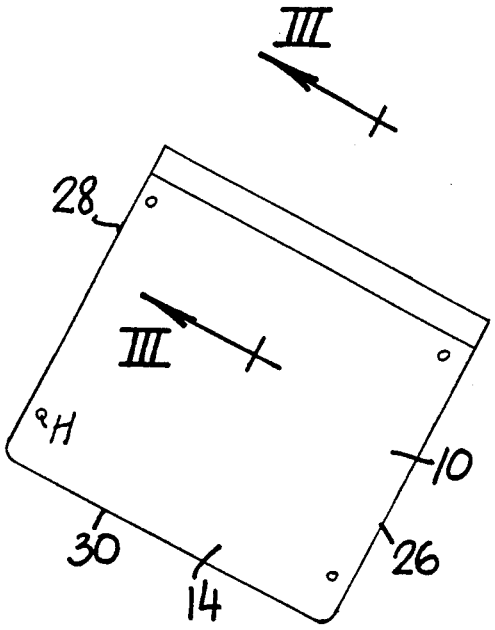
FIG. 2 is a view of the bag of FIG. 1 with the input section in curled posture to form a closure.

Referring next to FIGS. 1 and 2 therein is seen a container 10. FIG. 1 shows the container 10 with an input section 12 extending from bag section 14. The mouth of the bag section 14 is located in the area indicated at 16 with the input section 12 being integral with the bag section and extending therefrom. The input section 12 has a mouth section indicated at 18, articles introduced into the interior or internal chamber of bag section 14 being guided through the input section 12 through the mouth of the bag 14. Also appearing in FIG. 1 is a bar 20. This bar is of flat cross section but is generally curved as will be shown hereinbelow.

Figure 3:
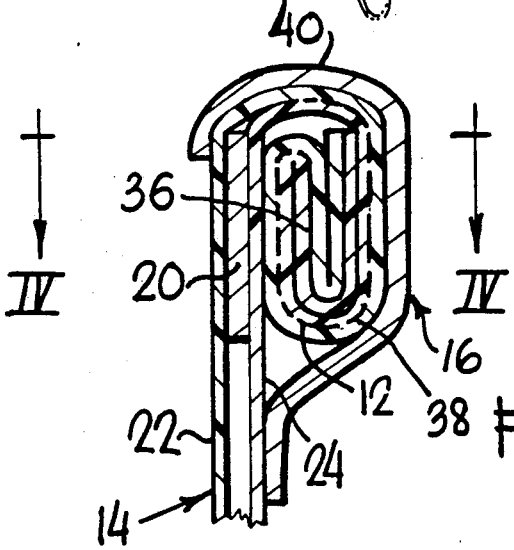
FIG. 3 is a view on enlarged scale and in section of a portion of the bag of FIG. 2, the view being taken along the section line III—III of FIG. 2.

FIG. 2 shows the bag with the input section having been curled upon itself to form a closure with the input section in this curled posture being held in this condition by means of a pouch-like structure or retainer as illustrated more clearly in FIG. 3.

In FIG. 3 are seen the two facing sections 22 and 24 of the bag section 14. Internally of these two walls is located the bar 20. This bar is affixed to one of the wall sections 22 and 24 by means of cement or by means of having been welded thereto. For this purpose the bar which may be fabricated for example of thin metal or plastic may be wrapped in a polymeric material suitable for being welded to the bag walls in order to hold the same in position at the mouth of the bag section 14, the bar traverses the bag substantially from lateral side 26 to lateral side 28 of the same.

The bag itself may be fabricated of any suitable polymeric material such as for example polyethylene or polypropelene. The bag is preferably of a monolithic structure folded back on itself along fold line 30 of bag section 14 to form the face-to-face walls 22 and 24 as mentioned hereinabove. The walls are sealed or gusseted along the lateral extremities thereof such as indicated at 26 and 28 by means of cement or welding or by sewing in conventional manner provided that the resulting seams are waterproof and capable of maintaining their integrity while the wearer of the bag is engaged in strenuous physical activity.

As appears in FIG. 3, the input section 12 is folded in a plurality of U-shaped curves thereby to form two U-shaped sections in nesting relationship with one another. One of the U-shaped sections is indicated at 36 and another of the U-shaped sections is indicated at 38. Because of this posturing of the input section 12 in curled configuration, the passage through the same follows a sinuous path with the surrounding walls being pressed into face-to-face relationship thereby to provide a seal or closure to prevent the entry of water or the like.

To hold the input section 12 in its curled posture there is provided the retainer 16. This retainer is preferably fabricated of rubber or knitted elastic fabric capable of retaining the input section in the form illustrated in FIG. 3. The retainer 16 is preferably provided in the form of a pouch being capable of being stretched in hooded relationship as indicated at 40 so that its extremity cups over the opposite side of the bag section 14 thereby to maintain the entire structure in fixed conformation.

As seen in FIG. 3, the bag section 14 has a width W1 which is greater than the width W2 of the input section. The retainer 16 thus is enabled to extend over the lateral extremities 46 and 48 of the input section 12 to cup over the ends thereof and to prevent the ingress of water into the interior chamber of the bag section 14.

Figure 4:
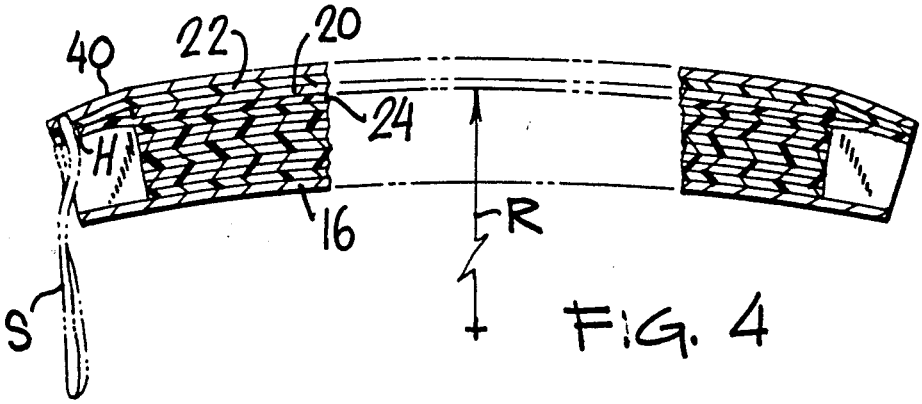
FIG. 4 is a cross sectional view taken along section line IV—IV of FIG. 3.

A section along section line IV–IV is illustrated in FIG. 4. Therein appears the bar 20 as well as walls 22 and 24. Also appearing therein is the retainer or pouch-like section 16. It will be noted that the bar 20 is curved. It has a radius R which makes the height of the arc segment constituting the bar 20 to be of relatively small magnitude. The radius R is of a magnitude which is greater than the width W1 of the bag section but is preferably such that it causes a displacement of the bag walls by an amount of from about ½ to 1½ inches and is preferably about 10% of the radius R. This curvature causes a stretching of the walls and the curled input section as well as of the retainer 16 to provide an enhanced closing of the closure formed by the various elements thereby to insure that no water or air can penetrate into the interior of the bag section 14.

As to the method of the invention this comprises forming a bag with a mouth and with an input section on the bag at the mouth and in extension of the bag, attaching a retainer to the bag at the mouth, curling the input section on itself at the mouth to affect a closure of the mouth and hooding a retainer over the thusly curled input section to maintain the closure.

The method also includes curving the bag and input section at the mouth to facilitate maintaining the closure, curving the bag and input section at the mouth by attaching a curved rigid member to the bag at the mouth, and curling the input section in the form of two nesting U-shaped sections which is the preferred means of closing the input section of the bag of the invention.

It will be noted hereinabove that the bar is positioned internally of the monolithic structure constituting the bag section to traverse the same at the mouth, the retainer being connected externally of the monolithic structure in correspondence with the bar to be imparted a curved form thereby.

It will also be noted that the margins of the bag walls can be provided with one or more openings such as indicated at H in FIG. 4 thereby to permit the connection thereto of a strap or leash indicated at S. These openings will accommodate one or more of such straps which may be of various sizes and permanently attached or detachable in order to permit selective connection to various parts of the body such as the wrist, waist, ankle, forearm or thigh as may be selected or preferred.

There will now be obvious to those skilled in the art many modifications and variations of the structure and method set forth hereinabove. These modifications and variations will not depart from the scope of the invention if defined by the following claims.

What is claimed is:

1. An article of manufacture comprising a bag having a mouth for the insertion of objects, an input section on said bag at said mouth to guide said objects into said bag and adapted for being curled in order to function as a closure for said mouth, retaining means adapted for being hooded over the input section with the latter in curled posture thereby to retain the closure at said mouth, said bag and input section being of a continuous monolithic structure, and a substantially rigid means of curved form on said structure at said mouth for imparting a curved conformation to said structure, said retaining means being of a pouch-like configuration defining a receptacle to receive the input section in the curled posture thereof, the monolithic structure having two opposed sections in face-to-face relation in the bag and input section, the opposed sections being laterally connected in watertight relation, said rigid means being positioned between the opposed sections of the bag adjacent the input section, the curled input section being in alignment with said rigid means for being held in curved conformation by the rigid means.

2. An article of manufacture as claimed in claim 1, wherein the retaining means is of knitted fabric.

3. An article of manufacture as claimed in claim 1, wherein the monolithic structure is of waterproof material.

4. An article of manufacture as claimed in claim 3, wherein said rigid means includes a curved bar connected to one of said two opposed sections at said mouth.

5. An article of manufacture as claimed in claim 4, wherein the curved bar has a radius which is greater than the width of the bag.

6. An article of manufacture as claimed in claim 4 wherein the curved bar causes a displacement of the bag at said mouth by about ½ to 1½ inches.

7. An article of manufacture as claimed in claim 4, wherein said bar is positioned internally of said monolithic structure to traverse the same at said mouth, said retaining means being of elastic material which is connected externally of the monolithic structure in correspondence with said bar to be imparted a curved form thereby.

8. An article of manufacture as claimed in claim 7, wherein the two sections of the monolithic structure are laterally connected to form flat margins provided with at least one hole adapted to accommodate a leash.

9. An article of manufacture as claimed in claim 1, wherein the retaining means is of elastic material.

10. An article of manufacture as claimed in claim 1, wherein the retaining means is of a greater width than the input section and is hooded over the lateral extremities of input section with the latter in curled posture.

* * * * *